United States Patent [19]

Dahnert

[11] 4,437,711

[45] Mar. 20, 1984

[54] MOVABLE STORAGE UNIT CONTROLS

[75] Inventor: Dean L. Dahnert, Fort Atkinson, Wis.

[73] Assignee: Spacesaver Corporation, Fort Atkinson, Wis.

[21] Appl. No.: 382,999

[22] Filed: May 28, 1982

[51] Int. Cl.[3] ..... A47B 53/00

[52] U.S. Cl. ..... 312/201; 312/223; 312/198

[58] Field of Search ..... 312/198–202, 312/223

[56] References Cited

U.S. PATENT DOCUMENTS

| | | | |
|---|---|---|---|
| 3,640,595 | 2/1972 | Staller et al. | 312/198 |
| 3,890,903 | 6/1975 | Showell | 312/198 X |
| 3,944,309 | 3/1976 | Taniwaki | 312/200 X |
| 4,033,649 | 7/1977 | Naito et al. | 312/198 X |
| 4,039,040 | 8/1977 | Spears et al. | 312/201 X |
| 4,119,376 | 10/1978 | Moyer | 312/199 X |

*Primary Examiner*—James T. McCall
*Assistant Examiner*—Joseph Falk
*Attorney, Agent, or Firm*—Henry C. Fuller

[57] ABSTRACT

A plurality of movable storage units each have a reversible motor for driving them in the proper direction in response to a user command to open an aisle between selected units. There is a microprocessor-based programmable control module on each unit and there is a structurally similar module that acts as a system controller. Four control lines interconnect the modules. One line is for sending digital command data away from the system controller and another is for sending sensing data toward the system controller. Another line is for resync pulses transmitted from the system controller to the microprocessors simultaneously. The processor in each module responds to a resync pulse by initiating definition of a specific number of time slots for containing individual high or low bits to enable serial transmission of encoded data representative of commands and sensed conditions. The modules on each unit interpret or sense such conditions as to whether their start push-button has been pressed, whether their limit switches are closed to indicate proximity with another unit and whether a safety switch is open or closed. This and other sensed information is sent serially to the system controller in serial form for being interpreted and the system controller sends back commands for enabling the unit modules to interpret the direction and limits of unit movement.

11 Claims, 7 Drawing Figures

MOVABLE STORAGE UNIT CONTROLS

BACKGROUND OF THE INVENTION

This invention pertains to mobile storage systems of the type wherein a series of storage units are movable on tracks to create an access aisle between two of the units and to establish the others in close, side by side relationship to thereby minimize the amount of floor space required. In particular, the invention resides in an improved electrical control system that governs automatic positioning of the units in response to a user request and that monitors safety conditions and the integrity of the system in a manner not heretofore achieved.

Some examples of movable storage units are library bookshelves, file cabinets, film storage files and racks used in warehouses and industry to store parts and finished and unfinished goods. Typically, the storage units are mounted on track-guided wheeled carriages each of which has at least one reversible electric motor for propelling it bidirectionally on tracks or rails which may be recessed in the floor. Typically, at least one outermost unit is stationary and the other units are controlled to move toward and away from it to form an aisle.

A desirable control system for effecting sequential movements of units to create an aisle is one wherein there is a motor control module of substantially identical type on each of the movable storage units and the modules are interconnected by conductors that allow cross-communication with each other. Such systems yield the economy that results from being able to manufacture a single type of control. This improves flexibility since the storage units and their control modules can be inserted or removed without requiring modification of other control modules.

Prior art electrical control modules of the type just alluded to are based on the use of relays to obtain the logic functions for controlling unit movement and for monitoring safety conditions. Hence, even though relay-based control modules may be identical in a particular system, if differences are desired in the functional characteristics or features to adapt to the particular requirements of any installation, it becomes necessary to modify, add or substitute hardware components in the control modules and to make changes in the electrical circuitry as well. For instance, it may be necessary to make sure that different safety conditions are met in one installation as compared to other standard installations before any unit will move in response to a user request or will stop if a certain unsafe condition arises. A system that can be modified easily to meet the functional and safety characteristics that may be required by different customers has never been achieved.

One of the problems in existing interconnected individual module control systems is the difficulty of determining the cause of a failure in the system and which module or interconnecting line or line the fault causing the failure has occurred.

SUMMARY OF THE INVENTION

The new control system for movable storage units described herein overcomes the aforementioned and other problems present in prior control systems.

One object achieved with the new control system is the use of identical control module hardware on each movable storage unit which modules require no hardware changes but only require easily made program changes in firmware to achieve a wide choice of functional features that may be desired in various movable storage unit installations.

Another important feature of the new control system is its ability to perform a self-test to determine if there are any short circuits or open circuits in the conductors that intercommunicate the modules and to determine if there are any faults in the electrical components that comprise the modules and to inhibit operation or movement of the storage units until any fault is corrected.

Another important feature of the invention is that the control modules are commanded and their conditions or states are sensed by way of serially transmitted digital data bits and words to obtain a number of advantages such as maintenance of synchronism between the control modules, communication of fault-indicating and proper operational indicating communication exchange between modules and for assuring that if a fault of any kind develops anywhere in the system energization of the electric motors that drive the unit carriages will be prohibited.

Other features of the new control system are that it can be programmed for providing any one or more of a selected variety of audible and visual signals for warning persons that movement of the storage units is impending and that they are in motion.

Also, the control system has signal input and output ports in the programmable modules that allow for sensing a variety of known and even not heretofore conceived conditions, such as safety conditions, and to output responses to these inputs for effecting control functions or warnings. Furthermore, the new control system is completely automatic and executes a complete operating or storage unit movement cycle after a single pushbutton switch is operated by the user and which requires no resetting operation by the user to prepare the system for another operating cycle.

Briefly stated, in accordance with the invention, each storage unit in a sequence of movable storage units is self-contained in that it has its own control module and its own motor or motors for propelling it. Each control module contains a microprocessor. The microprocessor used in the preferred embodiment is an 8-bit per byte type that has read/write memory or random access memory (RAM) on a single integrated circuit chip and a read-only memory preferably of the erasable type (EPROM) connected external to it. Semiconductor switches are provided in each module for switching the controllers for the storage unit drive motor or motors on and off provided all conditions for operation have been previously met. Each microprocessor has its own crystal-based clock and an internal timer for measuring timing intervals. Each storage unit has one or more limit switches on a side and the states of these limit switches are sensed to determine when movable units are compacted against each other in the process of forming an aisle. Each unit also has yieldable safety sweep bars at near floor level and switches on each side of the units are operated by these bars in response to a bar encountering any obstruction between units when they are moving. The limit and safety sweep switches are scanned at a very rapid rate by suitable devices associated with the microprocessor and control functions are executed in accordance with the states of the switches. One of the control modules, though it is structurally the same as others in the system, is designated the system controller module. Three primary conductors or lines and a ground line run from one module to the next adjacent module. One of the conductors is for carrying a resynchronization signal at regular periodicity from the system controller module to all of the other modules to maintain them in synchronism. The synchronization pulses are called resync signals herein. Another of the module interconnecting lines is called the command data-in line in that it transmits digital command data serially to and through individual modules in the sequence. Another of the four lines is called the sensing data-in line in that it conducts signals representative of sensed conditions to the module on a unit and to the system controller module. In other words, resync signals and command data flow from the system controller to the individual storage unit modules and sensing data flows from any control module that is remote from the system controller back through the sequence of control modules and to the system controller. The fourth line between all of the control modules is a signal ground line and is common to all modules.

In the preferred embodiment, each storage unit has a beacon lamp on it that is controlled by command bits from the system controller module and provides a visual flashing signal when the storage units move. In a preferred embodiment, the beacon lamps are caused to flash in synchronism, even though they are on separate storage units, to provide a particularly impressive warning when the units are in motion. One of the units, typically the one that has the so-called system controller mounted to it, has a warning horn that is caused to emit sound for a time interval following actuation by a user of a pushbutton start switch. Movement of all units is inhibited until expiration of the pre-movement warning interval.

The manner in which the objects and features mentioned above and other more specific objects and features are achieved will be evident in the more detailed description of a preferred embodiment of the invention.

DESCRIPTION OF A PREFERRED EMBODIMENT

Figure 1:
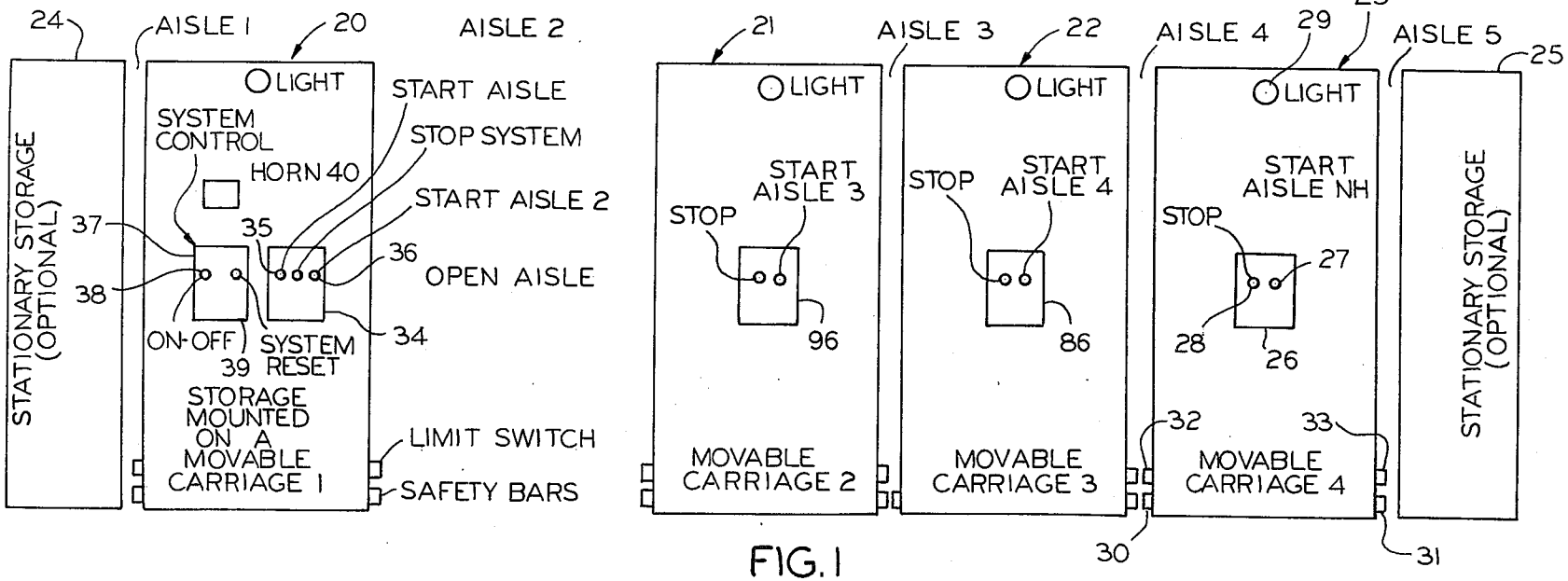
FIG. 1 is a partly diagrammatic side elevational view of a movable storage unit system embodying the invention.

FIG. 1 is a diagram of several storage units that are arranged to move alternately and selectively to the left and right as depicted to establish an access aisle between them. The tracks on which they move are not shown. The tracks can be in the form illustrated in U.S. Pat. No. 3,640,595, incorporated herein by reference. In this particular installation, there are four mobile storage units 20–23 that are arranged to move rectilinearly relative to each other to establish an access aisle between any pair of them. Optionally used stationary storage units 24 and 25 are also shown. Some installations may include only one stationary storage unit at one boundary of the system and a wall constitutes the other boundary. Units 21, 22 and 23 are presently parked and are closely adjacent each other such that no usable aisle space exists between them. Aisle 2, existing between units 20 and 21, is fully open to provide access by a person to the right and left sides of units 20 and 21, respectively. These storage units will be understood to be elongated in the direction perpendicular to the drawing to provide shelves or other storage compartments for books or articles of any kind. It should be understood at the outset that the new control system herein described is adapted for controlling, not only a four unit system shown in FIG. 1, but a system that has less or more storage units.

Storage units 21–23 are identical in all respects. A typical unit 23 has a control module, represented by the rectangle marked 26, mounted in it. Normally the control module would be concealed from view and only a "start" pushbutton switch 27 that is pressed by the user to initiate the aisle opening procedure would be accessible. Also accessible to the user is a "stop" pushbutton switch marked 28. This switch is pressed or actuated by the user when circumstances dictate the desirability of making an emergency stop while the storage units are in motion. Unit 23, like the others, has a beacon light 29 which is caused to flash and provide a warning signal when the units are in motion. There is a yieldable safety sweep switch bar, such as those marked 30 and 31 on each side of each movable unit. These bars extend over the length of the storage unit and actuate switches which cause motion of the storage units to be inhibited if an obstacle or impediment to their movement is encountered by the safety sweep bars. The safety sweep bars and their switches will be subsequently described in greater detail. There are also limit switches such as those marked 32 and 33 on each side of a movable storage unit for sensing when a storage unit is in proximity with an adjacent unit.

In FIG. 1, storage unit 20 carries the system controller module 34. Storage unit 20 is the only one that has two start switches on it. The other movable units 21–23 only have and need one. The controls are so designed that they decide in response to operation of a start switch which should move and in which direction the units must move to open an aisle. Pressing start pushbutton switch 35 associated with the system controller on storage unit 20 causes the storage units to be driven in a direction for opening up aisle 1 and closing presently open aisle 2. The other start pushbutton switch 36 may be pressed to open aisle 2 if storage unit 21 was compacted with storage unit 20. The system controller on storage unit 20 is labelled system control and indicated further by the reference numeral 37. A key-operated switch 38 is made accessible to the user for energizing or turning the system on and off to prevent unauthorized operation of the system. The controls are not energized unless key switch 38 is in its on state. A system reset switch 39 is also provided and is used when the system is energized to assure that the digital electronic components in the control modules are properly initialized. A schematically represented audible warning device such as a bell or horn 40 is also mounted on unit 20. As indicated earlier, this horn turns on immediately upon any one of the start switches 27 being operated to effect a change of aisle location. None of the storage units move until the horn has sounded for a predetermined and programmed time interval. By way of example, in one commercial embodiment, the horn sounds for about 3 seconds before storage unit movement is allowed.

Figure 2:
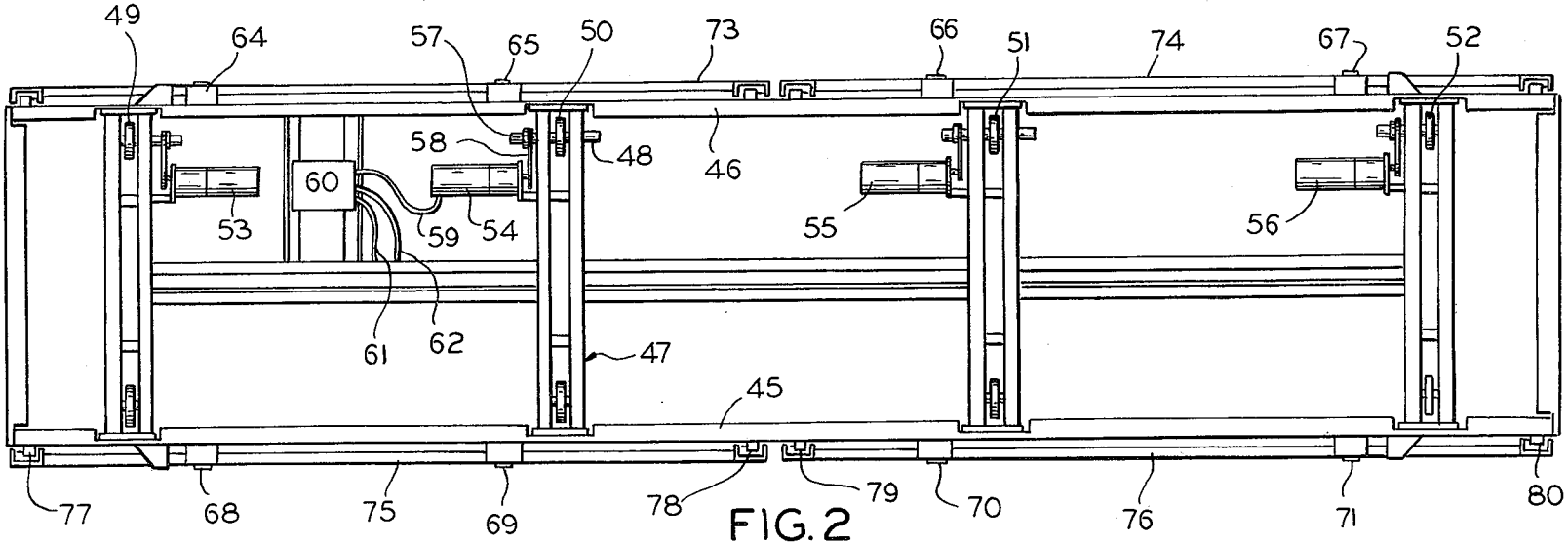
FIG. 2 is a plan view of a typical motor-driven carriage on which a movable storage unit is mounted.
Figure 6:
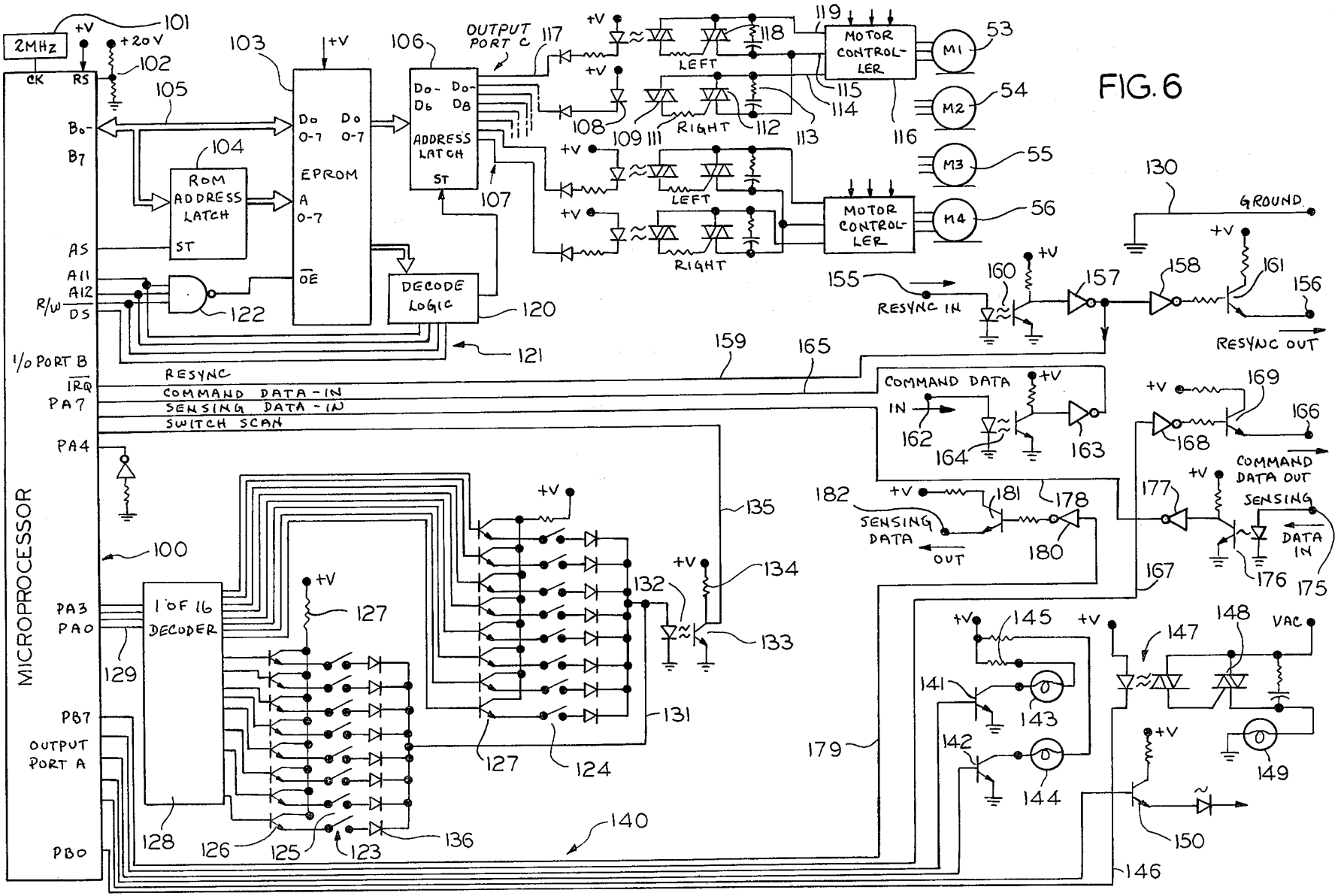
FIG. 6 is a detailed circuit diagram of a control module.

FIG. 2 is a plan view of a storage unit carriage with the shelving removed. The depicted carriage is a type that would be used for transporting very long and heavy storage units such as those used to store machine parts or structural steel pieces. The carriage in FIG. 2 is composed of laterally extending parallel steel channel members 45 and 46 which are tied together by cross-beams such as the one marked 47. A wheel drive shaft such as the one marked 48 is journaled on each of the respective cross members. The carriage has four drive wheels 49–52 for running on tracks. Because the carriage is a heavy duty type, four reversible drive motors 53–56 are used for driving the wheels, respectively. There is a sprocket such as the one marked 57 on the typical drive shaft 48 in proximity with each of the motors. Each motor imparts torque to a drive shaft 48 by way of a chain such as the one marked 58. The power cable leading to a motor is marked 59. This cable runs out of a reversing motor controller that is symbolized by the block marked 60. Although only one motor controller 60 is shown in FIG. 1 it will be understood that there is a controller for each of the reversible motors 53–56 as will be evident when FIG. 6 is discussed. Control lines 61 and 62 which carry the signals for energizing the motor controllers 60 and for effecting reverse operation are shown fragmentarily and it will be understood that these lines communicate with the control modules which were previously generally described and will be described in further detail later. Carriages for movable storage units such as library bookshelves usually require only one motor to drive them to the right and left as required since the load is small compared to loads imposed on the industrial type carriage depicted in FIG. 2. Typically, motors that operate on 480 volts ac are used. The electric power cables from the power lines that lead to the motor controllers 60 are not shown since the manner of handling the cables to accommodate distance changes between storage units is well known in the prior art.

Figure 3:
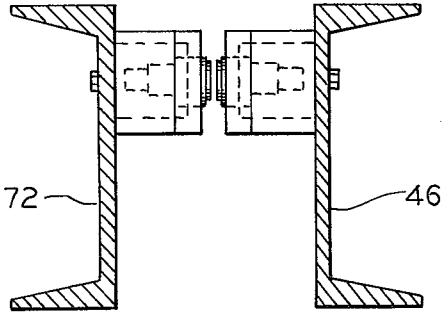
FIG. 3 shows a section of a structural channel member on each of two adjacent storage units where one member has a magnetic reed switch mounted on it and the other has a magnet mounted on it so these parts function as a limit switch.

In the FIG. 2 embodiment there are four limit switches 64–67 on one side of the carriage and another four switches 68–71 on the other side. These switches are used to sense when one movable unit is in proximity with other movable units or a stationary unit. Although various kinds of proximity sensors may be used, magnetically operated reed switches may be used advantageously. The manner in which the reed switches are mounted on one of the carriage frame channels 46 and another channel 72 on an adjacent movable carriage is depicted in FIG. 3. In long carriage units such as the one shown in FIG. 2 there is a possibility of the carriage becoming askewed on the rails on which it travels and being askewed when it reaches its final position so that it would not align securely with an adjacent carriage. The use of four limit switches on each side of the carriage make it possible with the control system constituting the invention to turn off the drive motors in sequence in accordance with the manner in which the limit switches approach each other so that the part of the carriage that is leading due to the askew condition will be stopped while the other drive motors continue to drive until the trailing part of the carriage catches up so that the storage units will compact squarely when an aisle is opened elsewhere.

Figure 4:
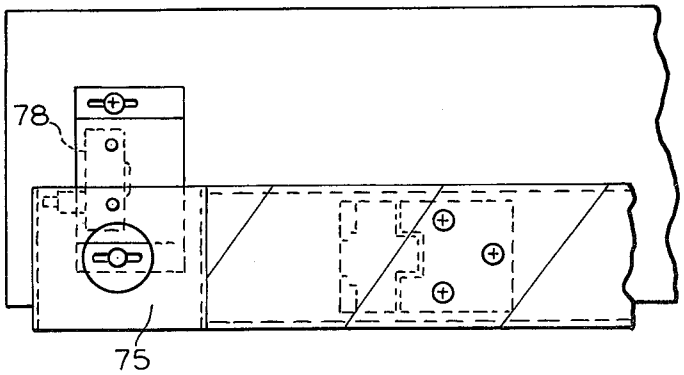
FIG. 4 shows some details of how the safety sweep or combination of movable bar and safety switch components are mounted on a carriage.

One side of each carriage is provided with a pair of sweep bars 73 and 74 and the other side is provided with a pair of sweep bars 75 and 76 which are spring-mounted and yield when the bars encounter a person or any other obstacle to carriage movement in an aisle while movement is in progress. Typically, four safety switches 77–80 are actuated by the sweep bars when an obstacle is encountered and there is a simultaneous deenergization of all of the drive motors as a result of the response of the control modules to any one or all of the safety switches opening. A typical sweep bar 75 and the switch 78 which it operates is depicted in FIG. 4.

Figure 5:
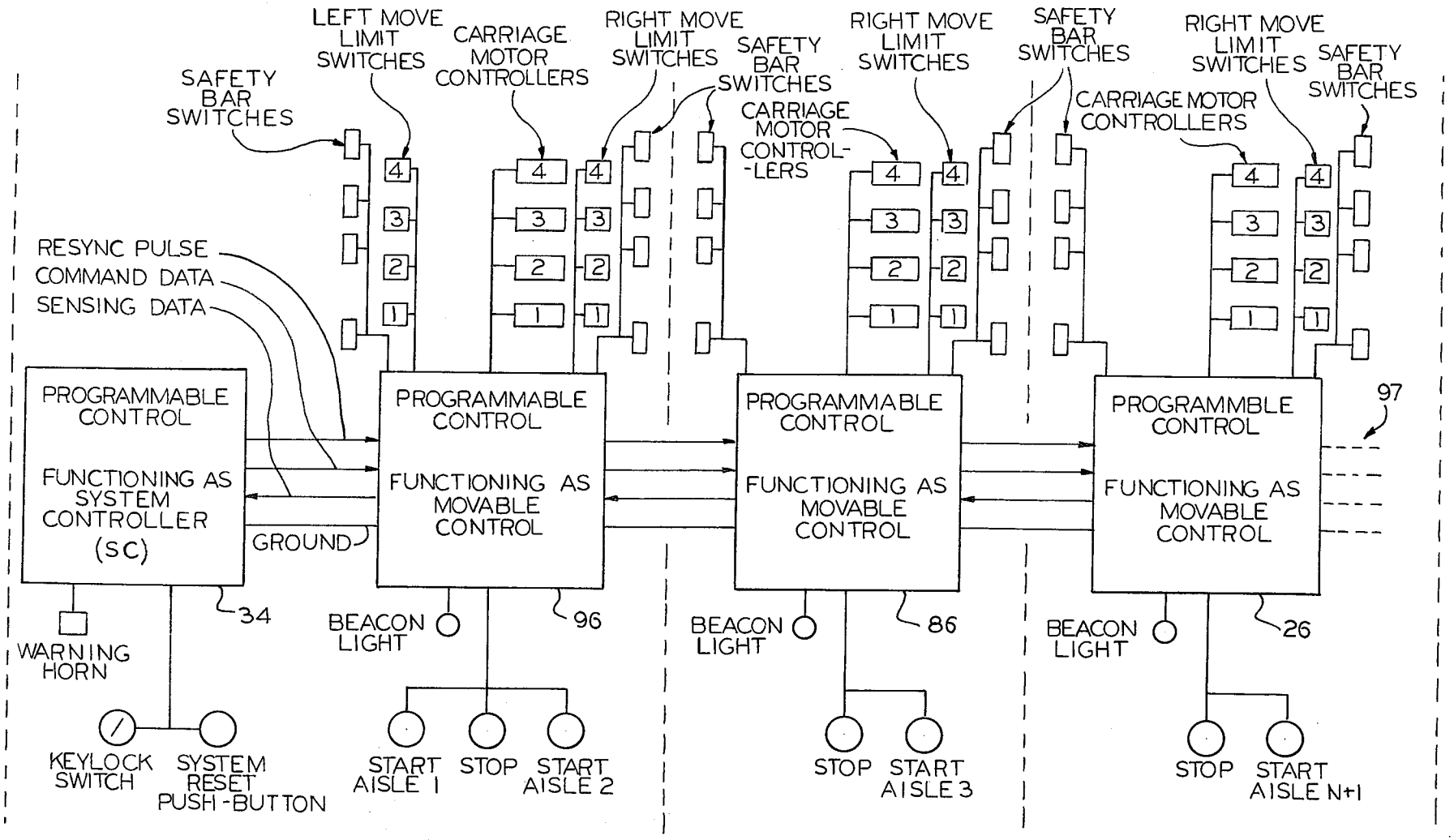
FIG. 5 is a block diagram of the control modules and their associated elements that are mounted on the storage units depicted in the four unit storage system of FIG. 1.

FIG. 5 is a block diagram of the new programmable electrical controls for a storage system that has four movable units as is the case in the FIG. 1 illustration. In FIG. 5, the programmable control modules are marked 34, 96, 86 and 26 correspondingly with their identification in FIG. 1. They are associated with storage units 20, 21, 22 and 23, respectively. Consider typical programmable control module 96 which is mounted to movable storage unit 21 in FIG. 1. Programmable control module 96 has several signal inputs and outputs as do the modules on the other storage units. The start pushbuttons are inputs and are labelled for aisle 1 and aisle 2 on unit 20. Assuming that the aisle to the left of the storage unit 20 on which control 96 is mounted is closed and that the user desires to open the aisle, the user would press the start pushbutton for aisle 1 and, after the integrity of the system is verified as will be explained, the storage units will be motor driven to the right until they are substantially abutting each other and aisle 1 will be open. Normally, in accordance with the invention, the user would only need to hold the start pushbutton depressed for part of a second and then release it after which all control and safety functions are performed automatically. If, however, an emergency arises or if the user has some other reason for desiring to stop storage unit movement, it is only necessary to press the pushbutton switch labelled "stop" and the system will deactivate all carriage motors and then return to a waiting-to-be-activated status.

Typical of the other movable control modules, programmable module 96 has an output for energizing a beacon light that is so labelled and that turns on and flashes in unison with other beacon lights on units that are in motion. The set of four limit switches on one side of the carriage or storage unit on which module 96 is mounted are labelled the "left move" limit switches. The four on the other side are labelled the "right move" limit switches. The states of the limit switches are sensed by the programmable control module with which they are associated. The storage unit having module 96 has the two sets of left and right move limit switches which sense proximity to storage units to the left and right. As indicated earlier, these may be magnetic reed switches in which case the magnets that operate them are mounted on an adjacent unit. For instance, the magnets for the left move limit switches may be on the storage unit that has system controller (SC) 34 on it and the magnets for the right move limit switches may be on the unit that has programmable control module 86 mounted on it. Thus, it will be seen that the right move limit switches on the unit having module 96 can sense limiting conditions associated with the unit on which module 86 is mounted. Since the right move limit switches associated with module 96 can signal the position of the unit that has module 86, there is no need for a set of limit switches on the left side of the unit that has a module 86.

Considering typical module 96 again, it also has as inputs the states of four safety bar or safety sweep switches that are on the left and right sides of each storage unit carriage as previously discussed in connection with FIG. 2.

Note that any movable control modules to the right of the first one, such as controls 86 and 26 only need one start button that is operative to open an aisle on either side of the associated storage unit. Each module, however, has a stop pushbutton for commanding emergency stops.

The system controller (SC) 34 is structurally identical to the other programmable modules on the movable units. SC 34 has a keylock switch which must be closed to power up the control system. There is also a "system reset pushbutton" which is operated to initialize the system when power has been off and after the system has been stopped due to an activation of a carriage safety bar. SC 34 also controls the warning horn, which, as was stated earlier, sounds for a predetermined time delay interval to warn that the storage units will be in motion in a few seconds after the start pushbutton has been pressed.

As mentioned earlier, there are only four conductors or lines interconnecting the system controller and all of the other controllers. Three of these conductors are digital data communication lines and the fourth is a ground line. In accordance with the invention, all data is transmitted serially. The lines are labelled ground, sensing data, command data and resync pulse where resync stands for resynchronization. The arrowheads on the lines indicate the direction of serial data flow. Thus, resync pulses which, by way of example and not limitation, are sent out every 32 ms so that the respective microprocessors in the individual control modules will maintain their synchronization and will measure timing intervals from the same starting point. The command data line transmits serial digital data from SC 34 to the ensuing movable control modules which are, in a sense, transparent to command data. The sensing data line returns digital data from the various movable control modules to the SC 34.

The four dashed-line extensions 97 in the right region of FIG. 5 of the control lines just discussed are to indicate that any reasonable number of additional control modules may be added to the system and become a part of the serial data transmission circuitry. Moreover, it will be evident that any control module and storage unit can be removed in which case it is only necessary to have those that remain be serially connected by a cable comprised of the four lines.

FIG. 6 shows in more detail the structure of a typical control module which may be any one that is functioning as a movable or as the system programmable control module. The hardware for each is the same. Each module contains a microprocessor 100. In a commercial embodiment, type MC 6805 microprocessors are used. They are 8-bit per byte processors. These microprocessors have a substantial amount of read/write memory (RAM) on-chip. In accordance with the invention, a plurality of microprograms can be fetched and executed by the microprocessor. During system operation, the microprocessor is programmed to execute a series of microprograms one after another in time slots or channels into which the time interval between resync pulses is divided as will be discussed in greater detail subsequently. The microprocessor has an external 2 MHz clock 101. The +V dc input to the microprocessor is a logic voltage level. The reset pin, RS, is connected to an intermediate point in a resistor voltage divider 102 and the divider is fed from a 20 V dc source in this case. If power line voltage drops, for example, the voltage from the divider drops and locks the microprocessor into a reset state so no change can occur until proper voltage is restored. This feature prohibits loss of synchronism or timing between the microprocessors in the individual modules.

Figure 7:
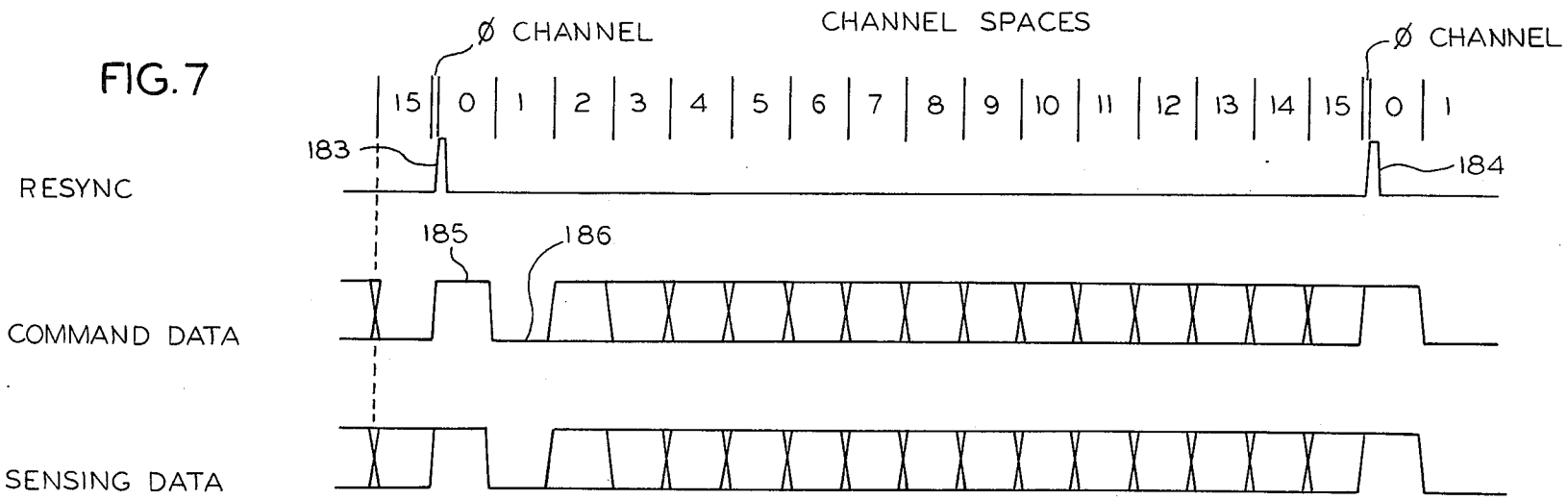
FIG. 7 is a timing diagram that is useful for explaining the invention.

An erasable programmable read-only memory (EPROM) 103 is preferably used for storing the microprograms and for other purposes. EPROM 103 is addressable through an address latch 104 that has a bus input from the microprocessor bidirectional address-/data bus 105. One eight-line output bus DO from the EPROM is for providing addresses to an address latch 106. The address latch is basically an output port that is labelled output port C. This latch is used as a primary control for the carriage motors. In FIG. 7, the four motors that would be present on a movable carriage or storage unit, such as motors 53–56 in FIG. 2, are also labelled M1–M4 in FIG. 7. These motors are turned on and off under the control of the microprocessor. The controls for each motor are identical. When any motor or all of the motors are to turn on and off, the microprocessor addresses EPROM 103 which couples the appropriate address to address latch 106 and the eight output lines 107 of the address latch switch from a high logic voltage level to a low level and become current sinks. Usually, when movement of a storage unit carriage is to be initiated, all of the output lines 107 will assume a low logic level at the same time and all of the motors M1–M4 will turn on simultaneously. However, as alluded to earlier, if when the storage unit is moving its carriage becoms askew the limit switches between the carriages will not open at the same time because of the angulation between adjacent carriages or storage units in which case the output lines 107 will be controlled by the microprocessor to go low level in an appropriate sequence for disabling the motors in a fashion that will result in the askew unit squaring up with the one against it which it will abut.

The control circuits for only motors M1 and M4 have been depicted but it should be understood that the omitted controls for motors M2 and M3 on the same storage unit are identical. Of course, it should be remembered that only one motor might be used on relatively low mass storage units. The control circuit for motor M1, for example, includes an optoisolator comprised of a light-emitting diode (LED) 108 that is optically coupled to a diac 109. When the line from the address latch 106 to the cathode of LED 108 goes low as previously described, diode 108 conducts and emits light which makes diac 109 conductive. Diac 109 then provides a signal through a resistor 110 to the control or gate of a triac 112 which turns on. An RC filter circuit 113 is connected across each triac. When the triac turns on, it closes the circuit between one input line 114 and a common line 115 which controls the motor controller 116. The controller responds by energizing motor M1, causing it to turn in a direction that causes the storage unit to be driven to the right. Of course, if there are several motors on the carriage they will all participate in driving the storage unit to the right. Another control circuit responds to output port C line 117 going low. This circuit functions in the manner of the circuit just described except that a triac 118 is turned on to provide a control signal between control line 119 and common line 115 to the motor controller 116 in which case motor M1 would drive the storage unit carriage to the left. Obviously, all motors on a unit will turn and drive in the same direction at one time. A control circuit for motor M4 is shown but need not be described since it is similar to the circuits that were just described.

A decode logic block 120 has several input lines 121 leading from the microprocessor 100. One of the lines labelled R/W on the microprocessor goes low and high in correspondence with whether writing or reading addresses to and from address latch 106 is underway. One of the lines labelled DS, standing for data strobe, provides a signal to the decode logic which results in strobing address latch 106. Through NAND gate 122, the microprocessor provides signals to the output enable, OE, pin of EPROM 103.

As will become clear later, whether or not motors M1–M4 run in one direction or the other depends upon whether a start pushbutton has been previously pressed on a storage unit controller and upon the state of the limit switches and safety sweep switches that are carried on the movable storage units and upon whether the system has fulfilled some other test conditions.

The various limit switches, safety sweep switches, start pushbutton switches, emergency stop pushbutton switches and the like that are associated with each programmable control module are symbolized by two switch arrays 123 and 124 in FIG. 6. Each switch such as a typical one 125 is in series circuit with the base-emitter circuit of a transistor 126. This and the other transistors above it all have their collectors connected to a common 20 volt +V source through a collector resistor 127. The bases of the transistors in the group that contains transistor 126 and the bases of those that contain transistors including the one 127 in the other array are all connected to output of a 1 of 16 decoder 128. The four input lines to the decoder from the microprocessor are marked 129. 4-bit code words in the value range of zero to 15 can be input to decoder 129 from the microprocessor by way of lines 129. The output lines of decoder 128, which are connected to the bases of the transistors, go to a logic high level in a sequence repeatedly under control of the microprocessor. If a switch in the array is closed, a circuit is completed through the typical transistor 126 which turns on and through switch 125, and a diode 136 to establish a connection with a common line 131. The other switch circuits in array 124 similarly connect to the common line 131. The common output signal line from the array of switch circuits is marked 131 and it is connected to the anode of a light-emitting diode which is part of an optoisolator 132 whose other part is a light activated transistor switch 133. The collector of this transistor is supplied with a collector voltage of 5 volts dc through a resistor 134.

It will be evident that the decoder 128 makes possible scanning of the open and closed states of the array of switches. Output transistor 133 in the optoisolator conducts if any switch is closed at a particular time in the scan sequence. The collector or output line 135 of optoisolator transistor 133 goes low every time a closed switch in the switch arrays is encountered during a scan. These signals, indicative of the switch states at any moment are input to the microprocessor by way of switch scan line 135. The scan frequency can be very fast so that the states of the switches are checked at high frequency and there can be a quick response by the system if, for example, a limit switch or safety switch opens.

It may be noted that in an actual embodiment, there is an LED, not shown, in series with each of the diodes such as the one marked 136. The LED's are useful for locating failures. For instance, a limit switch can be closed manually to determine if it is in good condition. If the LED goes on it indicates that the transistor, switch and diode are all without defect.

Microprocessor 100 has an output port A for eight output lines which are selectively designated by the numeral 140. These output lines control the base current to transistors 141 and 142 which are driver circuits from some indicator lamps 143 and 144. By way of illustration, one of the indicator lamps 143 is mounted in the start pushbutton assembly on a storage unit control module to provide a visual indication that a start pushbutton has been pressed. Upon this event, the control line in group 140 leading to the base of transistor 141 from output port A of the microprocessor goes to a low logic level and causes transistor 141, for example, to become conductive and turn on indicator lamp 143. The lamp is supplied from a 20 Vdc source through a resistor 145 which is in the collector circuit of the transistor along with the lamp 143. The other indicator lamp 144 is controlled in a similar fashion by switching transistor 142. Indicator lamp 144 could be for another start pushbutton.

Another line 146 from microprocessor output port A connects to the cathode of an LED which is part of an optoisolator 147 whose other part is a diac that is connected in a switching circuit that includes a triac 148. When line 146 goes to a logic low level, the diode in the optoisolator 147 activates the diac to provide a turn on signal to the gate electrode of the triac. The triac is supplied from a 24 Vac source in an actual embodiment and when it turns on, it provides current through an indicator lamp 149. This might be the beacon lamp on a movable storage unit. The system controller, SC 34, module has a similar circuit except that instead of it energizing a beacon lamp such as the one marked 49, it energizes a warning horn 40 which is substituted for the beacon lamp. As indicated earlier, the warning horn is controlled by the microprocessor to sound for a timed interval after which the motor control circuitry is enabled following actuation of a start pushbutton. Another transistor 150 is illustrated to suggest that additional outputs may be obtained from output port A to signal conditions or provide some specific control function if desired.

The four lines that provide communication between the control modules on the storage units and the direction of signal flow in them was alluded to previously in connection with FIG. 5. More information on how these lines are connected into the modules is given in FIG. 6. In this figure, one may see that the resync signal that has come from the system controller 34 and may have passed through preceding controllers is supplied to resync input pin 155 in the typical control module depicted in FIG. 6. The resync signal goes out to the next control module from the output pin 156 in a connector which is not shown. The resync signal is an input to the particular microprocessor shown in FIG. 6 and is supplied from a point between two inverters 157 and 158 to the microprocessor by way of a conductor 159 that is also labelled "resync." In modules other than the SC, the resync signals would flow in the direction of the arrowhead adjacent reference numeral 159. In the SC 34 control module, the resync signal direction would be opposite in that it is flowing out toward the modules on the individual movable storage units. In FIGURE, the resync signal input on connector pin 155 is supplied to the anode of a light-emitting diode in a transistor optoisolator 160. The collector of the transistor is connected through a resistor to a logic voltage level source. When the transistor in the optoisolator 160 conducts, its collector goes low and the output of inverter 157 goes to a high logic level to provide the positive-going resync pulse or spike to microprocessor 100 through line 159. The resync pulse is propagated through the other inverter 158 and turns on a transistor 161 such that the resync output pin 156 switches from a low voltage state to a high voltage state to reflect the resync pulse down the line to the next control module, if any. The collector of transistor 161 is typically connected through the illustrated resistor to a dc voltage source, such as a 20 Vdc source which assures that the output resync pulse will be maintained at an adequate amplitude down the line which might be important in large systems where there might be twenty or more additional movable storage units.

Handling the command data that is communicated from the system controller and from one remote or movable control module to the next one will now be discussed in connection with FIG. 6. Serial digital command data is input to a typical control module by way of connector pin 162. High and low logic level serial command data is coupled to the output of an inverter 163 through an optoisolator 164. The output of the transistor in optoisolator 164 and the output of inverter 163 go to high and low logic levels in correspondence with the logic levels of the bits in the serial data train. The output of inverter 163 is connected by way of a sensing data-in line 165 to one of the inputs in input-output port B of the microprocessor. The command data output pin or connector is marked 166. Command data going out are data that are supplied from output port A of the microprocessor in the SC and any other control module. A line 167 from output port A is input to an inverter 168 whose output is in the base-emitter circuit of a transistor 169. The emitter voltage level switches between high and low states and the voltage on output connector pin 166 follows at whatever the command signal level is during any bit time. It will be evident that serial command digital data can be input to any module by way of input pin 162 and can be output to the next control module by way of output pin 166. It should be further evident that any control module down the line from the system controller 34 can communicate with the ensuing module by way of the command data line.

The sensing data circuitry will now be discussed in reference to FIG. 6. As mentioned earlier, sensing data flows in the direction from the control module that is most remote from the system controller to all intervening control modules and to the system controller. The sensing data input connector pin is marked 175. Sensing data in serial digital format is coupled by way of an optoisolator 176 to the input of an inverter 177 whose output is connected by way of a line 188 to one of the pins I/O port B of microprocessor 100 which line is also labelled sensing data-in. Sensing data is transmitted out of output port A of the microprocessor and one of the lines 179 that leads from output port A. Sensing or sensed signals are fed through an inverter 180 whose output signal turns a transistor 181 on and off in correspondence with the logic level of the incoming data bits. The emitter of transistor 181 is its output and it is connected to sensing data line output connector pin 182. This connector pin would be connected to a sensing data input pin corresponding to the one marked 175 in FIG. 6 but in the control module that is next in line toward the system controller control module 34.

Now that the system has been described in general terms, a more detailed description of its functional features is in order. Assume that the key switch 38 is turned on and the system is energized but no aisle opening has been commanded as yet. At such time, the control module microprocessor 100 will output resync pulses at constant periodicity to each of the movable control modules by way of the resync pulse line which has been referred to in connection with FIGS. 5 and 6. The timing diagrams are shown in FIG. 7. One may see that resync pulses, two of which are identified by the numbers 183 and 184 have short duration. In this particular embodiment, the time interval between each pair of sync pulses may be considered to be divided into sixteen channels or time slots 0–5. The time slots correspond to digital data bits in the serial data transmission format. By way of example and not limitation, if the time between consecutive resync pulses is 32 ms, the individual time slots or channel spaces 0–15 will each have a duration of 2 ms. In any case, regardless of the total time between resync pulses, the time slot should preferably have equal durations. Assuming no start button has been pressed, the system controller just waits and each microprocessor resident in the controls on the other storage units just recycle through their consecutive microprograms between resync pulses but do nothing ordinarily. All control programmable modules on the storage units are sequencing through their 2 ms time slots in synchronism. The SC 34 module is sensing or waiting for incoming data. Every resync pulse resets the built-in programmable timer in each microprocessor so that the channels or time slots are run off in the order of 0 to 15 in this example.

Among other things, each EPROM 103 in a programmable control module on a storage unit has three 5-bit digital code words stored in it at three locations. One five-bit word defines the carriage or unit member. Another word corresponds to the indentity of a start pushbutton and is distinctive to the pushbutton on any individual storage unit. For those cases where there are two start pushbuttons, another stored five-bit digital word identified it. As is known, five-bit words can identify up to 32 carriages or storage unit modules. The 5-bits are assigned to five consecutive time slots or channels in the serial bit transmission format such as to channels 2–6.

The timing diagrams for command data and sensing data in FIG. 7 are drawn in a manner to indicate that in any time slot the corresponding digital bit may be at a high or low logic level to allow providing and sending two information states, at least, in each time slot.

The manner in which the system functions can be illustrated best by going through an operational sequence. Referring to FIG. 1, assume that the user desires to open aisle 4 to gain access between storage units 22 and 23. Aisle 2 is presently open. Before any action is taken by the user, resync pulses are being transmitted to all control modules on the individual storage units simultaneously. Now assume that the user has pressed the start pushbutton switch in module 86 of movable unit 22 which is on carriage 3 of FIG. 1 for the purpose of opening aisle 4. The user could also have used the start pushbutton switch 27 on storage unit 23 instead of on unit 22. Storage unit 22 whose start switch has been operated, is also designated as movable carriage number 3. Its identification code word is thus, digital or binary 00011. The system controller must be informed that it is movable carriage number 3 whose start pushbutton has been activated. The identification is sent to the system controller by way of the sensing data line of the four lines between the movable unit modules. Thus, for a binary number 3, the sensing data bits for channels or time slots 2, 3 and 4 would be zeroes and the time slots or channel spaces 5 and 6 would each be a 1. The system controller 34 does not cause any of the storage units to move until a number of other conditions are met. For one thing, the system controller must see the same storage unit identification code repeated several times, three times by way of example, before the system controller (SC 34) treats the information as being a valid identification of movable carriage 3. The three readouts are stored and compared. If they agree, it reveals that they are likely to not simply be due to noise or invalid signals. Noise signals are more likely to be random than exactly repeatable. This scheme eliminates the effect of noise and enhances the safety of the system in that false starts become impossible. When SC 34 determines that the storage unit identification is valid, it sends out a command in corresponding time slots 2–6, for example, to each of the storage units in the system. The module or microprocessor in each of the modules reads the series of data bits and stores this information in its own RAM as identification of the unit on which a start pushbutton was pressed. Thus, a moment later when any module must make a decision as to whether it should be the first to move and in which direction it should move, it can compare its own identification with the unit identification that has been transmitted to it from the SC to determine if it will be involved in movement.

Even before the unit identification is transmitted, SC 34 has been sending out the resync pulses and, during each time slot, the microprograms in the various modules have been running in correspondence with their assigned time slots at a very high rate but nothing has been happening. However, immediately after each resync pulse, whether or not a start pushbutton has been pressed, the SC module is sending out command bits which is for checking the integrity of the entire system. The first bit is a high level bit during 2 ms time slot 0 as indicated by bit 185 in FIG. 7. For example, assume resync pulse 183 in FIG. 7 has occurred. This sets the timers in each of the microprocessors in the respective control modules down the line to zero and timing begins. 2 ms of time are counted off for channel 0 in this embodiment. Thus, immediately after the sync pulse SC 34 sends out a logic high bit 185, this commands each mobile storage unit module to send out an arbitrary high logic signal to the next unit or module to its right and each of the next modules to the right looks for a high bit from the next module to the left. If no high level bit is received from the module to the left, it indicates to the particular module that there must be an open circuit or some other defect and the control modules all switch their logic to a state that inhibits movement by assuring that their drive motor remains deenergized. On the other hand, if the command data line is not interrupted the logic high command data bit in time slot or channel 0 will be returned as sensing data to the system controller to indicate that one of the line integrity tests has been passed. Each module stores the high bit if it has been received to be used later in deciding whether the motors should be turned on by command bits in the higher order time slots. During the next time slot 1, testing is continued. During time slot 1, a low or logic zero command bit 186 is sent from the SC 34. When the bit 186 in time slot 1 goes low, the individual control modules go through the same procedure as just described except that they put out a low logic signal on the command line to the next adjacent module. Each control module again examines the incoming low bit command and it puts out a low command to the next unit to its right. Then each module stores this information bit in its RAM to be used during a later time slot to decide if its motor should be turned on or not. If, during time slot 1, the input to a control module is not low as that bit 186 should be, it is an indication that something in the system is supplying current when it should not be and is illegal and indicative of a defect. Thus, unless each module has stored an indication that incoming command or test bit in channel 0 was high and the bit in channel 1 was low, none of the motors can be energized until the problem is corrected and the system is reset. It should be recognized that the check for the integrity of communication between control modules is made after every resync pulse during time slots 0 and 1. Hence, if any of the four intermodule communications circuits become opened or become current sinks when they should not be the system will lock out within a time no greater than the time between two successive resync pulses even if the storage units are in motion. Even if no start pushbutton switch has been operated the test command bits will be sent out to check if the system is communicating. If not, system lock out occurs and no module will issue a command to start its associated carriage drive motors.

Up to this point in the example of how aisle 4 may be opened, the test bits in time slots 0 and 1 have been discussed. The code word identifying the storage unit on which a start pushbutton has been multiplexed serially to the system controller several times between consecutive pairs of resync pulses and the SC 34 has verified that the identification is valid and not noise or some other spurious signal. Verification is complete during one of the channel 7 time slots and during the next cycle of time slots the system controller sends out the test bits assigned to channels 0 and 1 and follows it with transmission of the identified unit 5-bit unit identification code to all of the control modules during channels or time slots 2–6, for example. A high level command bit might then be transmitted in, perhaps, time slot 9. Whatever module has had its start button pressed would have this information in RAM and would by comparison interpret the high level bit in channel 9 as being a condition which must be responded to by turning on the indicator lamp associated with the start pushbutton that has been pressed. During existence of time slot 10, a low level bit or zero may be transmitted normally but this bit would go high in response to an emergency stop pushbutton having been pressed. When the bit goes high, it is sent to all the modules as a command and as a sensed signal to the system controller 34 which retransmits it during the next multiplex cycle and the microprocessors in the various modules respond by executing a microprogram that results in carriage drive motor operation in all of the units being inhibited. During other time slots up to fifteen in this example, additional microprograms are executed by the individual control modules. For instance, in one of the channels the microprograms may be executed for determining if the safety sweep switches on the units associated with respective control modules are closed or open. If any is open, of course, the modules respond by inhibiting motor operation. Similarly, in another time slot, each control module will check the state of the limit switches that are associated with it. Information indicative of whether a limit switch is opened or closed is retained in the RAM of the microprocessor in the module. Another of the time slots may have the assignment of a bit which SC 34 would send out as a high level command which can be read out by the individual movable storage unit modules to effectuate turning on and off or flashing their beacon lamps to attract attention to storage unit movement.

As stated earlier, the identification code for the unit on which a pushbutton has been pressed for part of a second is now held in the RAM of each microprocessor. If by way of the sensing data line, the SC 34 has been informed that all conditions for safe movement have been met, SC 34 will send out to all control modules a high "movement permissible" command bit in one of the higher numbered time slots that will enable movement of all storage units that are to be driven and moved in order to open up the selected aisle. If movement has been found to be permissible, the warning horn on the unit that has SC 34 has turned on after the carriage on which a start pushbutton has been pressed has been identified. As a result, a certain bit in one of the time slots stays low. At the end of the typically three second time delay period following the horn turning on, the bit goes high in one of the higher time slots. This is the "movement permissible" bit that is transmitted from the SC 34 to all units. The triacs such as 112 or 118 in the motor control circuits of FIG. 6 will turn on, respectively, in accordance with whether the motors are to drive the units to the right or left to open the aisle.

The modules must decide whether they are to cause driving of their associated storage unit to the right or left to open the desired aisle. As indicated, they have already stored a code word identifying the start pushbutton that has been requested. The modules compare their own 5-bit identification code with the code that has been stored. If a module determines that its identification number is smaller than the carriage identification code number on the unit whose start pushbutton has been operated to make the aisle opening request, that individual unit will be conditioned to move to the left provided its limit switches and its safety sweep switches are closed in the direction in which movement is to take place. Thus, the the example where aisle 4 is to open, storage unit 21 on movable carriage 2 would be the first to move since closure of its left limit switches has been sensed and its right limit switches are closed because aisle 3 is closed. All of the modules execute their microprograms for checking the states of the limit switches to which they relate during the same time slot or within 2 ms in the described embodiment.

Assuming that carriage 2 having storage unit 21 has begun to move, the left limit switches of storage unit 22 on carriage 3 will close. This is sensed by the control module on unit 22 by scanning the switch arrays 123 and 124 in FIG. 6. Carriage 2 and its storage unit 21 stop moving when its left limit switch is open due to unit 21 compacting with unit 20, thereby closing aisle 2. Movement of carriage 3 and its storage unit 22 terminates when its left limit switches are opened as the result of unit 22 compacting with unit 21.

As indicated earlier, when the storage units are very long there is a chance for them to become askew on their tracks so that opening of a single limit switch could terminate movement of the unit before it is compacted squarely with an adjacent unit. In accordance with the invention, in the large storage unit installations where multiple limit switches are used as was mentioned in reference to FIG. 2, the control module resident on the same unit checks the states of the limit switches individually. During the end of unit movement a limit switch at one end of a unit opens because of the unit making contact with an adjacent unit. If the units are askew, three of the limit switches could still be opened. During the time slot in which the limit switches are tested, the one open limit switch would result in turning off of the triac 112 or 118, depending on movement direction, in FIG. 6 such that motor M1 would turn off. Motors M2, M3 and M4 would continue to run until the limit switches associted with them open. Thus, the microprocessor responding to states of limit switches, controls motor operations selectively in order to bring about termination of unit movement only after the units are properly aligned on their tracks.

It is important to recognize that command data flowing out from the system controller 34 to the other control modules and sensing data flowing back to the system controller from the control modules is repeated between each two successive resync pulses. Thus, after every resync pulse, the communication line integrity tests are made again during time slots 0 and 1. Thus, after every resync pulse from the system controller, all of the control modules shut shown and start reading the successive channel or time slot bits each 2 ms again. In other words, the program in any movable control module only runs for 36 ms in this example and it must be reactivated with a new resync pulse. Even through the triac triggers go dead at the end of each program cycle, the triacs continue to conduct anyway for the rest of the half ac power line cycle and the motor controllers remain locked in and they do not deenergize the motors. Thus, the motors are actually turned off every 36 ms in this example during unit movement so that if a single resync pulse is missed or if the command data line or the sensing data line or the ground line open the fault will be detected in no longer than the interval between two successive resync pulses and the system will respond by turning off all of the drive motors within the next one or two intervals between resync pulses which means that in this example, they would all turn off and stay off within 36 or 72 ms. This is a short enough time to preclude occurrence of any accident. Checking the entire control system integrity repeatedly between every pair of resync pulses is an important feature of the invention. Anything that goes out of order causes the entire system to be shut down.

The safety sweep switches, if there is more than one on each side of the storage unit, are all connected in series with each other so that if any one of them were closed when they should not be this condition would be detected by the control module and sent as sensing data to the system controller 34. SC 34 would then, after the next resync pulse, send out a command to all modules that would result in inhibiting all operation.

It should be recognized that the microprocessor in each of the control modules has access to a microprogram for each time slot or channel between resync pulses. When a resync pulse occurs, the microprogram during the ensuing time slot and all the rest of the time slots are operating in a closed loop mode. In other words, the programs can be executed completely many times during each time slot which can be 2 ms or more or less depending on performance factors that must be met. The concept of using a microprogram for each time slot enhances the versatility of the system. It allows expanding on the number of conditions that might be checked or the number of system responses such as turning on warning lamps or even signalling at a location very remote from the storage units that someone is manipulating the storage units. Many different sensed safety conditions, for example, could be allotted to different time slots. Thus, a customer's preference as to how a system should be operated can be programmed in the factory of system manufacture or a customer's initial desires. If the customer for a particular installation decides a different mode of operation would be desirable, it is only necessary to substitute EPROMs that are differently programmed. The operating characteristics for a system desired by any customer can be satisfied without making any significant change between installations other than program changes.

In general, every channel's microprogram has several specific inputs from devices on the carriage to make and store in RAM along with specific pieces of information to place on the command data line and the sensing data line. The microprograms also input the status of the command data-in and the sensing data-in line and store them in RAM. The microprograms also make whatever decisions are pertinent to the variables of that microprogram and stores them in RAM. All channel spaces or time slots have a specific high logic or low logic definition and represent a bit of information on the four data communication lines between storage units.

In a sense, every control module microprocessor tells its neighbors what its status is. For instance, if during movement the emergency stop pushbutton is pressed, the module carrying the particular stop button records the information in its memory. When the next assigned time slot for that information occurs, that module will send out a high logic bit, for example, on the sensing line that propagates the signal to the system controller 34. The system controller compares the incoming signal and drops the outgoing command signal low. This command signal is propagated from module to module and causes the modules to go into a stop motor state. Each module, of course, has a microprogram for the particular time slot so that the signal change does not have to wait for a complete multiplexing of all the bits or time slots between resync pulses to disable all of the motors. They are disabled within the same time slot during which the sensed data was sent out. The indicator lamp associated with the start pushbutton that has been operated is also automatically turned off in the time slot to which this function has been assigned. Every microprogram actually interprets the stop signal. It compares the stop bit with the state of its own stop switch and can tell that its own stop switch has not been operated but that one down the line has been.

It is important to note that the system controller is programmed to watch the incoming safety signals such as the limit switch, sweep switch and emergency stop signals and a signal or bit in the sensing data direction that indicates a storage unit is in motion. Any time a unit is in motion, it is transmitting the sensing bit. As long as there is movement, the system controller is thereby informed and it goes into a hold state. When the last carriage or storage unit has reached its limit and is no longer moving, this sensing bit goes low in the particular time slot. When the last carriage stops and there is an absence of this bit, the system controller senses it and resets for a new start pushbutton operation.

In the foregoing specification, specific values were used to typify functions such as the durations of time slots, resync pulse frequency and repetition rates. It should be understood that these specific values were used to obtain the clarity that attends using concrete numbers and are not intended to be limitations.

Although a preferred embodiment of the new storage unit control system comprised of identical and programmable control modules has been described in considerable detail, such description is intended to be illustrative rather than limiting, for the invention may be variously embodied and modified and is to be limited only by interpretation of the claims which follow.

I claim:

1. Storage apparatus comprising:

a series of storage units at least some of which have storage faces and some of which are selectively movable for creating an aisle between a pair of units for access to the faces of the separated storage units, guide means for guiding said units in a direction normal to said storage faces, reversible motor driven means mounted on respective units for driving the unit selectively in one direction or the other and a controller for each motor responsive to alternate control signals by energizing and determining the driving direction of the motor, a plurality of structurally similar programmable control modules at least one of which is mounted on each movable storage unit and one of which acts as a system controller (SC) module, each of said modules including digital processor means, at least one limit position sensing means on each storage unit which means is in an operated state when it is in proximity with any of an adjacent movable unit or a stationary unit and is in an unoperated state when spaced from any of said units, at least one manual start switch mounted on each movable storage unit for selection of the desired access aisle, first circuit means for transmitting resync pulses, generated by the processor means in said SC module with a constant interval between them, to the processor means in the other control modules simultaneously, second circuit means interconnecting said modules for transmitting serial data bits out of said SC module and from one control module on a storage unit to the next one, third circuit means interconnecting said control modules for transmitting serial data bits from module to module and into said SC module, the processor means in each control module on a movable storage unit responding to receipt of a resync pulse by initiating definition of a sequence of time slots in each of which a bit can be transmitted, the processor means in the control module of the storage unit whose start switch has been operated responding to operation by causing the bits for a digital code word corresponding to the numerical identification of the unit to be transmitted serially to said SC module in successive time slots while said start switch is being operated and the processor means responding to occurrence of valid identification by transmitting said identification code word to each of the control modules on the movable units for the processor means on the unit to compare said code word with its own identification code to determine the direction in which its storage unit should move, the processor means sensing that its limit position sensing means is unoperated responding by causing the one of said alternate control signals to be applied to said motor controller that causes said storage unit to be driven until the limit sensing means on said unit is operated.

2. A storage unit system comprising:

a series of storage units at least some of which are movable in opposite directions to compact some units for creating an aisle between a pair of units, means for guiding said units for rectilinear movement, a reversible motor mounted on respective units for driving the unit selectively in one direction or the other and a controller for each motor responsive to alternate control signals by energizing and determining the driving direction of the motor, a plurality of structurally similar programmable control modules at least one of which is mounted on each movable storage unit and one of which acts as a system controller (SC) module, each of said modules including digital processor means, at least one limit position sensing means on each storage unit which means is in an operated condition when it is in proximity with any of an adjacent movable unit or a stationary unit and is in an unoperated condition when spaced from any of said units, safety sweep switch means located on each of the opposite sides of at least said movable storage units and changeable from an unoperated to an operated condition by manual operation or by encountering an obstruction to movement of a unit, at least one start switch mounted to each movable storage unit for opening an aisle adjacent to that unit, first circuit means for transmitting resync pulses generated in said SC module at constant intervals simultaneously to the processor means in each of said control modules and said processor means responding to each resync pulse by synchronously initiating measurement of a series of time slots, at least some of said time slots having a bit assigned to them corresponding to a distinctive command or sensed condition, second circuit means interconnecting said modules for transmitting serial bits out of said SC module and from one control module on a storage unit to the next one, third circuit means interconnecting said control modules for transmitting serial data bits from module to module and into said SC module, the processor means in the control module of the storage unit whose start switch has been operated responding to operation by causing the bits for a digital code word corresponding to the numerical identification of the unit to be transmitted serially to said SC module in successive time slots while said start switch is being operated and the processor means responding to occurrence of valid identification by transmitting said identification code word to each of the control modules on the movable units for the processor means on the unit to compare said code word with its own identification code to determine the direction in which its storage unit should move, the processor means sensing that its limit position sensing means is unoperated responding by causing the one of said alternate control signals to be applied to said motor controller that causes said storage unit to be driven until the limit sensing means on said unit is operated.

3. The system as in claim 2 wherein:

there are a plurality of reversible drive motors on a storage unit and corresponding plurality of motor controllers, and a plurality of limit sensing means spaced apart from each other on a side of the unit, said processor means sensing the condition of said limit sensing means when said unit is moving and responding to operation of any one of the limit sensing means by providing a signal for deenergizing its motor while any other motor is permitted to run until its corresponding limit sensing means is operated, to thereby prevent said unit from stopping askew to its line of motion and non-parallel to the adjacent storage unit.

4. The system as in claim 2 wherein:

if said processor means in said SC module sensed bits from the control modules on the storage units indicative that all conditions have been met for permitting movement of the units to open an aisle said SC module will transmit a logical high movement permissible bit in one of the time slots to the other modules for the processor means in each module to be enabled to cause drive motor energization when the limit sensing means on the unit goes into unoperated condition.

5. The system as in claim 2 wherein:

in at least one of said time slots after each resync pulse said SC module transmits a logical high test bit by way of said second circuit means and if the processor means in the control module on a first storage unit senses the incoming high bit and the module is operable it transmits a logical high bit to the next module, if any, or to the SC module by way of said third circuit means such that if a logical high bit is not returned to said SC module during said time slot said SC module will shut down the system.

6. The system as in claim 2 wherein:

in at least one of said time slots after each resync pulse said SC module transmits a logical low test bit by way of said second circuit means and if the processor means in the control module means senses the incoming low bit it transmits a logical low bit to the next module, if any, or to the SC module by way of said third circuit means such that if a logical low bit is not returned to said SC module during said time slot said SC module will shut down the system.

7. The system as in any of claims 5 or 6 wherein:

if said processor means in said SC module senses bits from the control modules on the storage units indicative that all conditions have been met for permitting movement of the units to open an aisle, said SC module will transmit a logical high movement permissible bit in one of the time slots to the other modules for the processor means in each module to be enabled to cause drive motor energization when the limit sensing means on the storage unit goes into unoperated condition, and if one or the other or both of said test bits are not sensed by said SC module said module will be inhibited from transmitting said movement permissible bit to thereby prevent energization of any drive motor.

8. The system as in claim 4 including:

an indicator light source associated with the start switch on each movable unit, one of the time slots relating to the indicator lamps, operation of a start switch on a storage unit being sensed by the processor means in the control module of that unit and said processor means responding by sending a bit to said SC module in said one time slot, the processor means in said SC module, after having sensed that all of the conditions have been met for permitting unit movement, transmitting a bit in said one time slot during a following series of time slots and the processor means related to the start switch that has been operated responding to said bit by causing said light source to be energized.

9. The system as in claim 4 including:

an electrically activated audible warning device, said processor means in said SC module, after having sensed that all conditions have been met for permitting movement of said units responding by causing said warning device to be activated.

10. The system as in claim 9 wherein:

said processor means in said SC module is operative to delay transmitting said movement permissible bit in its time slot until said audible warning device has been activated for a predetermined amount of time.

11. The system as in claim 4 including:

a beacon light source on each movable storage unit, another of the time slots relating to the beacon lamps, the processor means in said SC module after having sensed that all conditions have been met for permitting unit movement, transmitting a bit in said other time slot to the processor means on the respective module storage units, each of the processor means responding by causing said beacon light sources to be turned on and off in synchronism.

* * * * *